US008771155B1

(12) United States Patent
Bell

(10) Patent No.: US 8,771,155 B1
(45) Date of Patent: Jul. 8, 2014

(54) EXERCISE APPARATUS FOR ASSISTING IN STRENGTH EXERCISES

(75) Inventor: Mark A Bell, Woodland, CA (US)

(73) Assignee: Super Training Products LLC, Davis, CA (US)

( * ) Notice: Subject to any disclaimer, the term of this patent is extended or adjusted under 35 U.S.C. 154(b) by 312 days.

(21) Appl. No.: 13/014,695

(22) Filed: Jan. 26, 2011

Related U.S. Application Data

(60) Provisional application No. 61/298,271, filed on Jan. 26, 2010.

(51) Int. Cl.
*A63B 21/00* (2006.01)

(52) U.S. Cl.
USPC ..... 482/124; 482/125

(58) Field of Classification Search
USPC ..... 482/124, 125, 121, 907; 602/5, 16, 26
See application file for complete search history.

(56) References Cited

U.S. PATENT DOCUMENTS

| | | | | |
|---|---|---|---|---|
| 2,808,267 | A | 10/1957 | Heaton | |
| 3,324,851 | A | 6/1967 | Posner | |
| 3,724,846 | A | 4/1973 | Perrine | |
| 4,273,328 | A | 6/1981 | Ozbey | |
| 4,570,929 | A * | 2/1986 | Shoemaker | 482/125 |
| 4,629,183 | A | 12/1986 | Perrine | |
| 4,722,524 | A | 2/1988 | Waszkeleicz | |
| 4,799,675 | A | 1/1989 | Helmer | |
| 4,890,841 | A | 1/1990 | Brooks | |
| 5,308,305 | A | 5/1994 | Romney | |
| D347,673 | S | 6/1994 | Armstrong | |
| 5,573,487 | A * | 11/1996 | Wallner | 482/124 |
| 5,607,378 | A | 3/1997 | Winston | |
| 5,683,336 | A | 11/1997 | Pape | |
| 5,938,572 | A | 8/1999 | Spano | |
| 6,616,581 | B2 | 9/2003 | Gwyn | |
| 6,666,801 | B1 | 12/2003 | Michalow | |
| 7,476,185 | B2 | 1/2009 | Drennan | |
| 2003/0045408 | A1 | 3/2003 | Seles | |
| 2007/0000015 | A1 | 1/2007 | Alaniz et al. | |
| 2008/0214330 | A1 | 9/2008 | Goebel | |

OTHER PUBLICATIONS

Letter from Moller to Alaniz 2008 (copy provided by Alaniz to Mark Bell Apr. 16, 2010).
Letter from Moller to Alaniz 2009 (copy provided by Alaniz to Mark Bell Apr. 16, 2010).

* cited by examiner

*Primary Examiner* — Jerome W Donnelly
(74) *Attorney, Agent, or Firm* — Edward B. Weller

(57) ABSTRACT

An exercise apparatus comprises first and second arm cuffs and a central elastic member. The first and second arm cuffs are configured to encircle right and left arms, respectively, of an exerciser. Each arm cuff is configured to encircle an elbow of the arm, a portion of an upper arm of the arm, and a portion of a lower arm of the arm. The first and second arm cuffs are attached to opposite sides in a longitudinal direction of the central elastic member. The central elastic member has a substantially rectangular shape and has a length sufficient to extend across a chest of the exerciser and for the first and second arm cuffs to encircle the right and left arms, respectively, of the exerciser.

25 Claims, 5 Drawing Sheets

EXERCISE APPARATUS FOR ASSISTING IN STRENGTH EXERCISES

RELATED APPLICATIONS

This application claims the benefit of, and the priority under 35 USC §119(e) from U.S. provisional application No. 61/298,271, filed on Jan. 26, 2010, which is incorporated by reference herein in its entirety.

FIELD

This disclosure relates to exercise apparatuses, and more particularly to exercise apparatuses that assist the user in strength exercises such as the bench press and push-ups.

BACKGROUND

Various exercise devices have been proposed for improving the effect of an exercise. Some exercise devices distribute weight during exercise.

U.S. Pat. No. 4,722,524 (to Waszkelewicz) discloses a weight lifting aid for barbell lifting or arm curls. The weight lifting aid includes a rigid member that has a concave surface for fitting on the shoulders of the weightlifter during barbell lifting or across the stomach during arm curls. The rigid member distributes weight away from the nape of the neck during barbell lifting. This weight lifting aid is not designed for push-ups or bench presses.

Some exercise devices restrict the movement of the arms or legs during exercise.

U.S. Pat. No. 2,808,267 (to Heaton) discloses a golf practice arm restraint that controls movement of the arm during a golf swing. The golf practice arm restraint comprises a harness that includes an stretchable member that is disposed on the user's back. An anchoring band attached at one of the stretchable member is worn around the golfer's shoulder of the arm. Another anchoring band attached at the other end of the stretchable member is worn around the upper arm of the golfer. The anchoring band over the shoulder restricts the movement of the arm during the swing of the golf club.

U.S. Pat. No. 3,324,851 (to Posner) discloses an arm restraining device for restricting the movement of the arms of the person wearing the device. The device includes an inelastic belt member with a pair of elastic arm restraining bands on opposite ends of the belt member.

U.S. Pat. No. 3,724,846 (to Perrine) discloses a weight lifting harness worn on a shoulder to keep the biceps, triceps and forearm muscles in predetermined positions during a weight lifting exercise. The harness includes a U-shaped yoke that fits across the chest during a weight lifting exercise. Ends of the yoke include pads that are positioned against the biceps during the weight lifting exercise.

U.S. Pat. No. 4,629,183 (to Perrine) discloses a U-shaped yoke that fits across the chest during a weight lifting exercise. A U-shaped pivotable arm support is selectively positioned against the biceps or triceps during a weight lifting exercise.

U.S. Pat. No. 4,799,675 (to Helmer) discloses an arm locking device for weightlifters that includes a strap that is non-elastic that is worn across the chest of the weightlifter. Loops are attached at opposite ends of the strap for wrapping around the upper arm of the weightlifter. The arm locking device holds the arms of the weightlifter in a relatively fixed position to prevent cheating during lifting by keeping the elbows close to the body.

U.S. Pat. No. 6,616,581 (to Gwyn) discloses a biceps and triceps isolator. The isolator assists a weightlifter in maintaining proper arm position while exercising. The isolator includes an elongated flexible strap, which is substantially non stretchable in its axial dimensions. A buckle adjustably holds the ends of the strap in fixed positions, relative to each other. The weightlifter places his arms over the biceps and triceps through a loop formed by the strap. The loop holds the upper arms of the weightlifter in a desired position while the weightlifter is exercising.

U.S. Pat. No. 6,666,801 (to Michalow) discloses a shoulder stabilization system that uses an actuator to engage the arm that is being trained distal to the axis of rotation of the joint. The actuator provides resistance to the arm as the arm is moved.

U.S. Pat. No. 7,476,185 (to Drennan) discloses a hip stabilizer to prevent hip dislocations. The hip stabilizer includes a girdle and thigh cuffs. Elastic cables are connected to the girdle and the thigh cuffs to provide tension that prevents rotation of the girdle.

These devices are directed to restricting movement during exercise and are not directed to assisting push-ups or bench presses.

Other exercise devices provide resistances during exercise.

U.S. Pat. No. 4,273,328 (to Ozbey) discloses a chest muscle and posture developer. The muscle developer includes a pair of arm bands. Each arm band has a back section attached thereto. The arm bands are elastic in one direction. The back sections are fastened to each other and worn across the back of a user. The back sections stretch longitudinally.

U.S. Pat. No. 5,308,305 (to Romney) discloses a sleeve-like apparatus that includes a sleeve having a removable elongate distance member therein. A wrist cuff holds the one end of the elongate distance member, which is connected at an opposite end to a shoulder harness. Flexing of the arm stretches the elongate distance member for exercising.

U.S. Pat. No. 5,573,487 (to Wallner) discloses an exercise device that uses progressive resistance for exercising the legs. The exercise device includes collars formed of flexible elasticized material that are secured in the region of the knee using mating hook-and-loop fasteners. A pair of resistance members is attached to the collars. The user exercises by walking, running or lifting one leg to stretch the resistance members to produce a tension from the stretching.

U.S. Pat. No. 5,607,378 (to Winston) discloses an exercising device that exercises biceps and triceps by using a resistance to muscle expansion. The exercising device includes gussets to hold weights. The exercising device further includes a band that is wrapped around the muscles to be exercised. The expansion of the muscles expands the band which provides resistance to the muscles.

U.S. Pat. No. 5,683,336 (to Pape) discloses an exercise device that includes a resistance arm connecting the arm to the body or an upper arm to a lower arm. The resistance arm provides tension against muscle movement for the exercise.

U.S. Pat. No. 5,938,572 (to Spano) discloses a weight resistance exercise training device for exercising leg, hip and buttocks muscles. The training device is strapped to the leg above the knee. The training device includes a central compartment and side compartments that each hold sand. Elastic straps hold the training device to the leg and allow movement of the leg.

U.S. Published Patent Application No. 2003/0045408 (to Seles) discloses an exercise device that includes a central elastic portion and a pair of cuff portions. The cuff portions are attached to a person's ankles. During exercise the central elastic portion is stretched when the ankles are further separated.

U.S. Published Patent Application No. 2008/0214330 (to Goebel) discloses an apparatus for restricting arm movement during exercise. The apparatus includes two wrist cuffs connected by an elastic cord to limit the separation of the wrists.

These devices are directed to restricting movement during exercise and are not directed to assisting push-ups or bench presses.

Other exercise devices are directed toward competitive weightlifting.

U.S. Published Patent Application No. 2007/0000015 (to Alaniz et al.) discloses an athletic shirt that stores energy during weightlifting. The shirt is formed of a non-elastic material. The shirt stretches to absorb energy from lowering the weight and to expend the energy while raising the weight. The sleeves of the shirt twist to absorb energy from lowering the weight and to expend the energy while raising the weight.

This athletic shirt is formed of a non-elastic material using twisting action for weightlifting. The shirt requires the assistance of another person to put on. The athletic shirt cannot be used during push-ups.

SUMMARY

It is desired that an exercise apparatus assist in the ability to do bench presses or pushups. It is also desired that the exercise apparatus allow the exerciser to lift more weight while bench pressing without increasing the risk of injury.

It is further desired that the exercise apparatus be easy to put on and use.

In one aspect, the exercise apparatus absorbs the eccentric (lowering) phase of a bench press or push-up, and assists in the concentric (raising) phase of the bench press or push-up.

In another aspect, an exercise apparatus comprises first and second arm cuffs and a central elastic member. The first and second arm cuffs are configured to encircle right and left arms, respectively, of an exerciser. Each arm cuff is configured to encircle an elbow of the arm, a portion of an upper arm of the arm, and a portion of a lower arm of the arm. The first and second arm cuffs are attached to opposite sides in a longitudinal direction of the central elastic member. The central elastic member has a substantially rectangular shape and has a length sufficient to extend across a chest of the exerciser and for the first and second arm cuffs to encircle the right and left arms, respectively, of the exerciser.

In various aspects, the central elastic member stretches to allow movement of the right and left arms when the right and left arms of the exerciser are in an eccentric phase of an exercise and contracts when the right and left arms of the exerciser are in a concentric phase of the exercise. The central elastic member may be elastic in a longitudinal direction and substantially inelastic in a transverse direction. Each of the first and second arm cuffs includes an opening therein configured to allow the exerciser to grasp the arm cuff for pulling the arm cuff up the arm of the exerciser while putting on the exercise apparatus. Each of the first and second arm cuffs may be elastic to allow stretching in the longitudinal direction.

In yet another aspect, an exercise apparatus comprises first and second elastic members. Each elastic member has a substantially rectangular shape with first and second long sides and first and second short sides. The first and second elastic members are affixed to each other substantially along the first long sides. Each of the first and second short sides are affixed to the first and second elastic members to form first and second arm cuffs configured to encircle right and left arms, respectively, of an exerciser. Each arm cuff is configured to encircle an elbow of the arm, a portion of an upper arm of the arm, and a portion of a lower arm of the arm. Each elastic member has a length sufficient to extend across a chest of the exerciser while the first and second arm cuffs encircle the right and left arms, respectively, of the exerciser.

In various aspects, the first and second elastic members stretch to allow movement of the right and left arms when the right and left arms of the exerciser are in an eccentric phase of an exercise and contracts when the right and left arms of the exerciser are in a concentric phase of the exercise. The first and second elastic members are elastic in a longitudinal direction and substantially inelastic in a transverse direction. Each of the first and second arm cuffs includes an opening formed between the first long sides of the first and second elastic members configured to allow the exerciser to grasp the arm cuff for pulling the arm cuff up the arm of the exerciser while putting on the exercise apparatus.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

DETAILED DESCRIPTION

A preferred embodiment of the present invention is now described with reference to the figures where like reference numbers indicate identical or functionally similar elements. Also in the figures, the left most digits of each reference number corresponds to the figure in which the reference number is first used.

Reference in the specification to "one embodiment", "an embodiment", "various embodiments" or "some embodiments" means that a particular feature, structure, or characteristic described in connection with these embodiments is included in at least one embodiment of the invention, and such references in various places in the specification are not necessarily all referring to the same embodiment.

All publications, patents, and patent applications cited herein are hereby incorporated by reference in their entirety for all purposes to the same extent as if each individual publication, patent, or patent application were specifically and individually indicated to be so incorporated by reference.

The exercise apparatus of the present invention allows an exerciser to do more push-ups or bench press repetitions than the exerciser could do without using the exercise apparatus. The exercise apparatus comprises an elongated elastic center region for resting against the chest of the exerciser and right and left arm cuffs for wrapping around a portion of the arms near the elbow of the exerciser. The center region may be disposed against the chest during exercise. The exerciser inserts his or her arms into arm cuffs of the exercise apparatus with a central portion of the apparatus across the chest of the exerciser. As the exerciser lowers the barbell towards his chest during a bench press, the central region and the arm cuffs of the exercise apparatus stretch, and as the exerciser lifts the barbell away from his chest the exercise apparatus contracts to thereby assist in the lifting of the barbell. Similarly, during push-ups, as the exerciser lowers his body toward the ground, the central region and the arm cuffs of the exercise apparatus stretch, and as the exerciser pushes his body away from the ground the exercise apparatus contracts to thereby assist in the lifting of his body.

Figure 1:
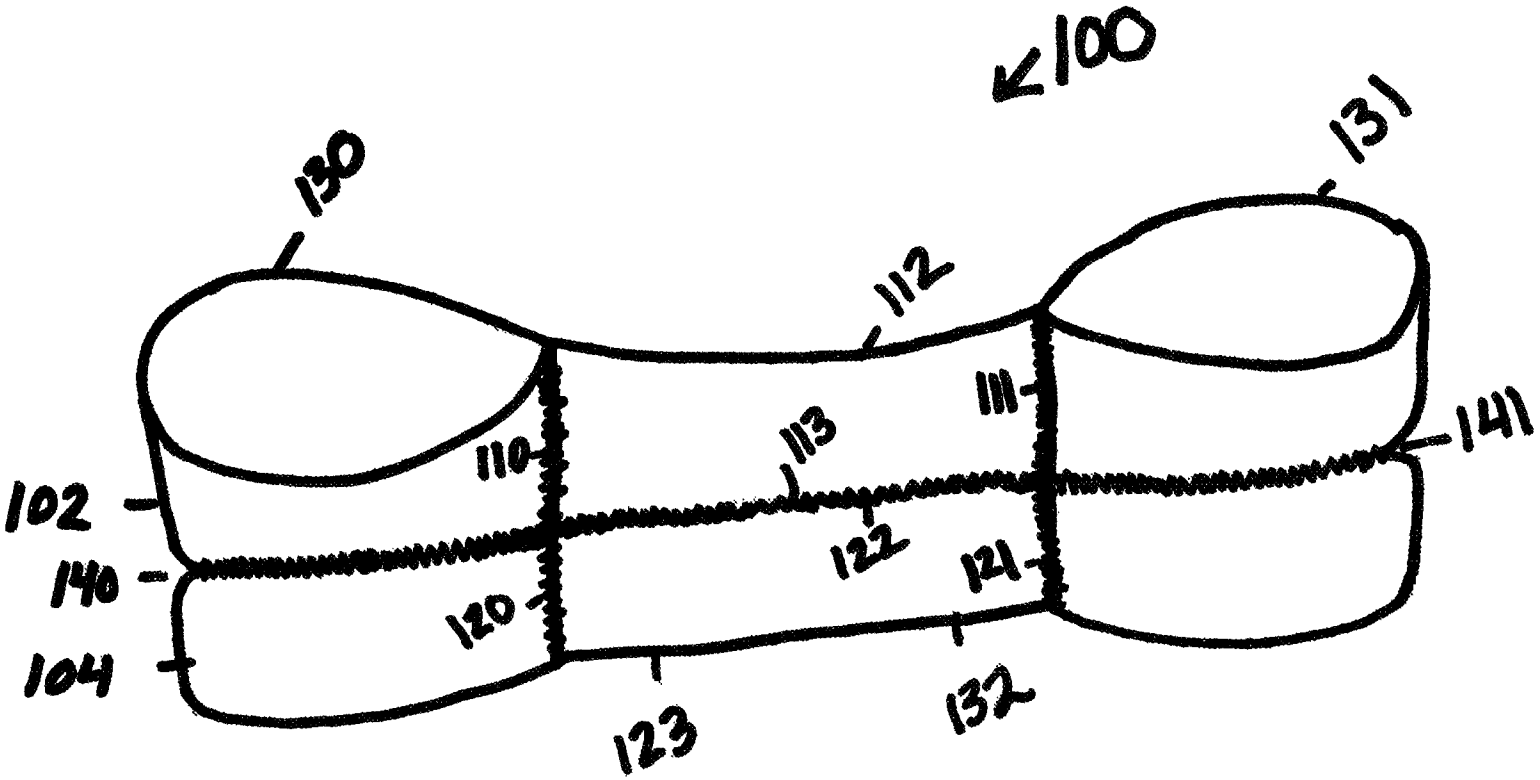
FIG. 1 is a perspective view of an exercise apparatus according to the innovations herein.

FIG. 1 is a perspective view of an exercise apparatus 100 according to the innovations herein. The exercise apparatus 100 comprises an upper elongate member 102 and a lower elongate member 104. The upper elongate member 102 has a substantially rectangular shape with ends 110 and 111 and sides 112 and 113. The lower elongate member 104 has a substantially rectangular shape with ends 120 and 121 and sides 122 and 123. The side 113 of the upper elongate member 102 is attached to the side 122 of the lower elongate member 104 to form an elongate member having a substantially rectangular shape. The sides 113, 122 may be attached to each other by sewing using a polyester thread. The upper elongate member 102 and the lower elongate member 104 are folded at both ends with the ends 110 and 120 attached to the upper elongate member 102 and the lower elongate member 104, respectively, to form an arm cuff 130 and the ends 111 and 121 attached to the upper elongate member 102 and the lower elongate member 104 to form an arm cuff 131. A central portion 132 is formed between the arm cuffs 130, 131. The ends 110, 111 and the ends 120, 121 may be attached to the upper elongate member 102 and the lower elongate member 104, respectively, by sewing using a polyester thread.

The arm cuffs 130, 131 are configured to encircle the right and left arms, respectively, of an exerciser. Each arm cuff 130, 131 is configured, shaped and sized to encircle the arm of the user in the area adjacent to and including the elbow, for example, between a point on the forearm below the elbow of the arm and a point on the upper arm above the elbow. The arm cuffs 130, 131 may be have a width selected based on the size of the exerciser or the exercise. The arm cuffs 130, 131 may be tapered so that the upper part of the cuffs 130, 131 are larger to accommodate large biceps and triceps. The arm cuffs 130, 131 may be contoured to accommodate the changing width of the upper arm and lower forearm.

Slots 140 and 141 are formed in the arm cuffs 130 and 131, respectively, between the upper elongate member 102 and the lower elongate member 104 to form openings to allow the exerciser to grasp the arm cuffs 130, 131 while putting on or taking off the exercise apparatus 100. In some embodiments, the slots 140 and 141 are formed by not sewing portions of the side 113 of the upper elongate member 102 to corresponding portions of the side 122 of the lower elongate member 104. In other embodiments, the slots 140 and 141 are formed by sewing the side 113 of the upper elongate member 102 to the side 122 of the lower elongate member 104 and cutting portions of the sewn sides to form the slots 140, 141. The edges around the slots 140, 141 may be sewn for reinforcement. In some embodiments, the upper elongate member 102 and the lower elongate member 104 are formed as a single member and the slots 140, 141 are formed by cutting openings in the single member.

The central portion 132 has a length sufficient to extend across a chest of the exerciser and for the first and second arm cuffs 130, 131 to encircle the right and left arms, respectively, of the exerciser. The central portion 132 may be have dimensions selected based on the size of the exerciser or the exercise. In some embodiments, both the upper elongate member 102 and the lower elongate member 104 have a length of about 45 inches and a width of about 4 inches. In various embodiments, both the upper elongate member 102 and the lower elongate member 104 have a length of about 36 inches and a width of about 3 inches. The arm cuffs 130, 131 have a loop inner diameter of about 12 to 16 inches. The arm cuffs 130, 131 may be formed with various sizes, such as small, medium, large, extra large (XL), extra extra large (XXL) and triple extra large (3XL).

In other embodiments, the arm cuffs 130, 131 are formed separately from the central portion 132 and are attached to the central member 132. In various embodiments, the arm cuffs 130, 131 are detachable from the central portion 132, and fasteners or other attachment apparatus provide sufficient force for maintaining the attachment of the arm cuffs 130, 131 to the central portion 132 during exercise.

In some embodiments, the upper elongate member 102 and the lower elongate member 104 are formed of an elastically yielding, stretchable, and shape restoring material. The material may permit repeated deformations within a defined range without degrading its elasticity. In some embodiments, the upper elongate member 102 and the lower elongate member 104 are formed of a material that is elastic in a longitudinal direction and is substantially inelastic in a transverse direction. The upper elongate member 102 and the lower elongate member 104 may be, formed of an elastic material, such as elastance (spandex or lycra), or a nylon supportive material. The type, properties and characteristics of the elastic material may be selected based on a desired assistance level for the exercising. In some embodiments, the elasticity of the upper elongate member 102 and the lower elongate member 104 provides an increase of about 10 to 20 percent in weight for bench pressing, or about 10 to 20 percent of bodyweight assistance for push-ups.

Although the central portion 132 has been described as being formed of a single layer, in some embodiments, the central portion 132 may include one or more layers of elastic material. In various embodiments, an elastic member (e.g., elastic webbing, or cord or tubing, such as surgical tubing) may be disposed between the layers or on a layer.

During exercise, the exercise apparatus 100 may mimic natural muscle movement, by lengthening and shortening with the muscles to provide support during the eccentric and concentric phases of a bench press or push-up to thereby reduce stress on the shoulders, elbows, and chest.

Figure 2:
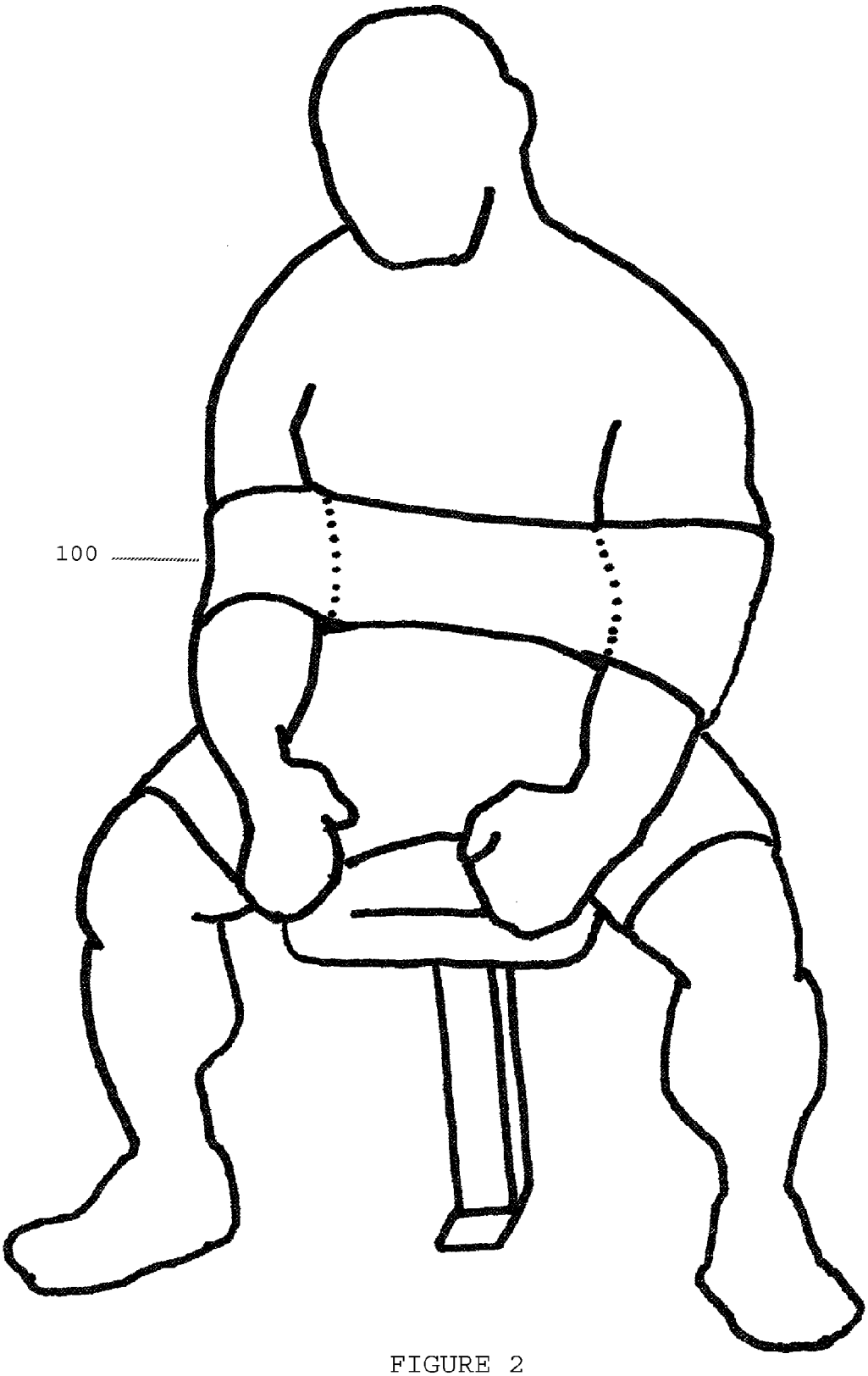
FIG. 2 is a drawing illustrating an exerciser wearing the exercise apparatus of FIG. 1.

FIG. 2 is a drawing illustrating an exerciser wearing the exercise apparatus 100. For push-ups or bench press, the exercise device 100 is put on and worn in the same manner. The exerciser places an arm through one arm cuff (e.g., arm cuff 130), and slides the arm cuff 130 up the arm so that the arm cuff 130 covers the lower bicep and the upper forearm with the elbow near the center of the arm cuff 130. The arm cuff 130 should be secure on the arm. The slots 140, 141 may be used to grasp the exercise apparatus 100 for pulling the apparatus 100 up the arm. The exerciser repeats the process for the other arm cuff (e.g., arm cuff 131). The exerciser may put on the exercise apparatus 100 without the assistance of a training partner. The exerciser should select a size of arm cuffs 130, 131 so that the exerciser may install the exercise apparatus 100 without assistance.

Figure 4:
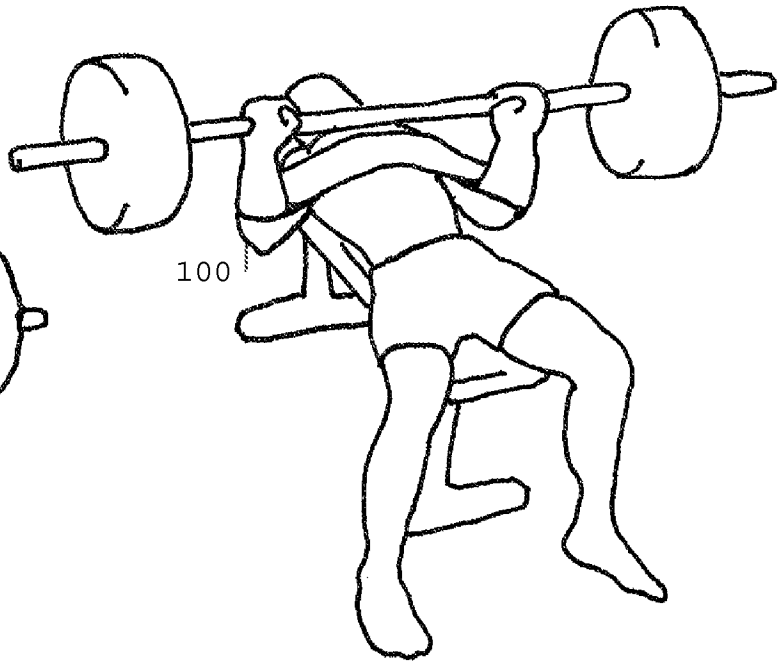
FIGS. 3 and 4 are drawings illustrating an exerciser using the exercise apparatus of FIG. 1 while bench pressing.
Figure 3:
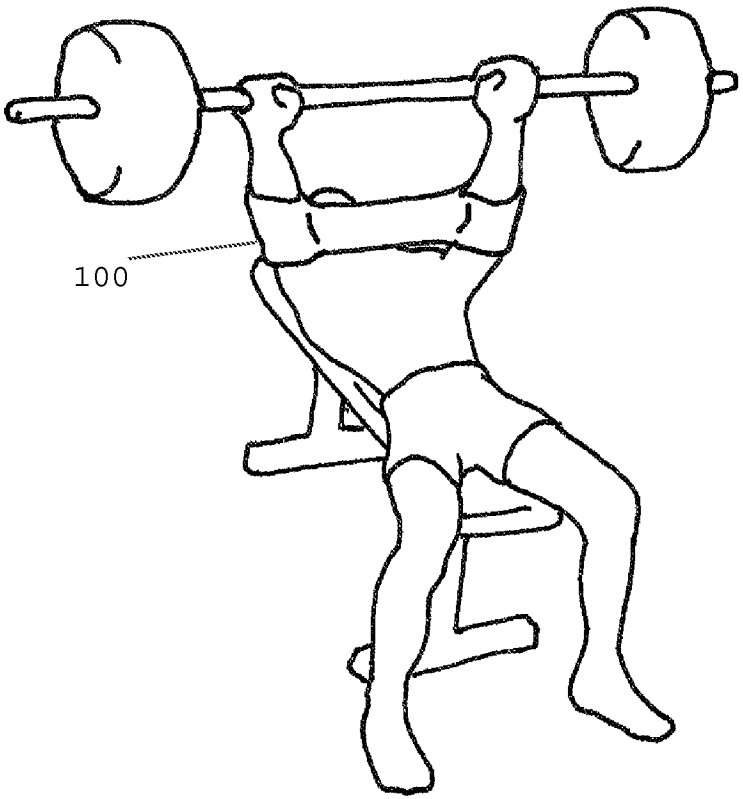

FIGS. 3 and 4 are drawings illustrating an exerciser using the exercise apparatus 100 while bench pressing. As shown in FIG. 3, the exerciser lays on a bench, and grabs and holds the bar in a similar manner as the exerciser would bench press without using the exercise apparatus 100. As the exerciser lowers the bar, the arm cuffs 130, 131 and the central portion 132 stretch. As shown in FIG. 4, the exercise apparatus 100 is stretched across the chest of the exerciser and the arm cuffs 130, 131 below the front of the chest of the exerciser. The stretched exercise apparatus 100 provides a force to contract to thereby assist the exerciser in lifting the bar as the exerciser lifts the bar. The exercise apparatus 100 may be used for various forms of bench presses, such as flat bench press, incline bench press or decline bench press.

Figure 5:
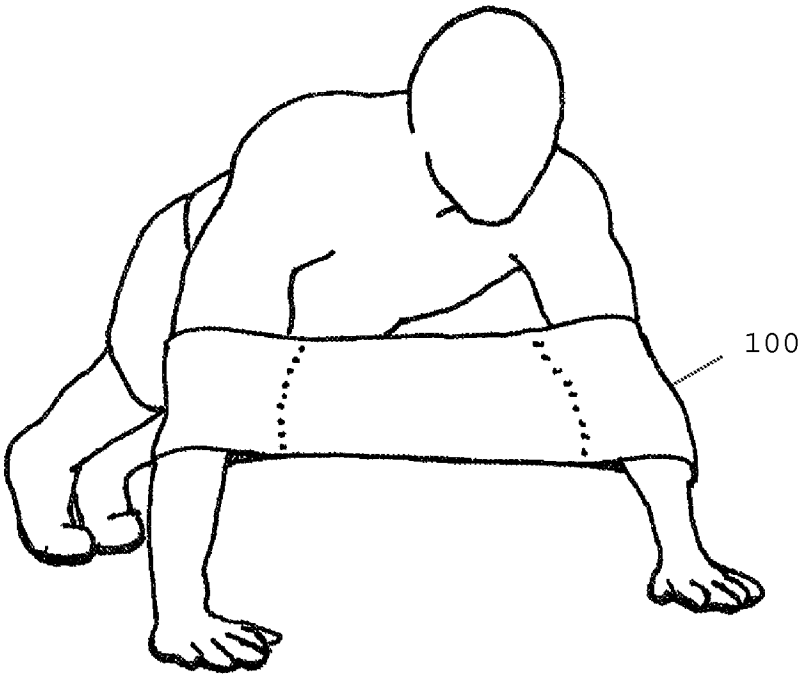
FIGS. 5 and 6 are drawings illustrating an exerciser using the exercise apparatus of FIG. 1 while doing push-ups.
Figure 6:
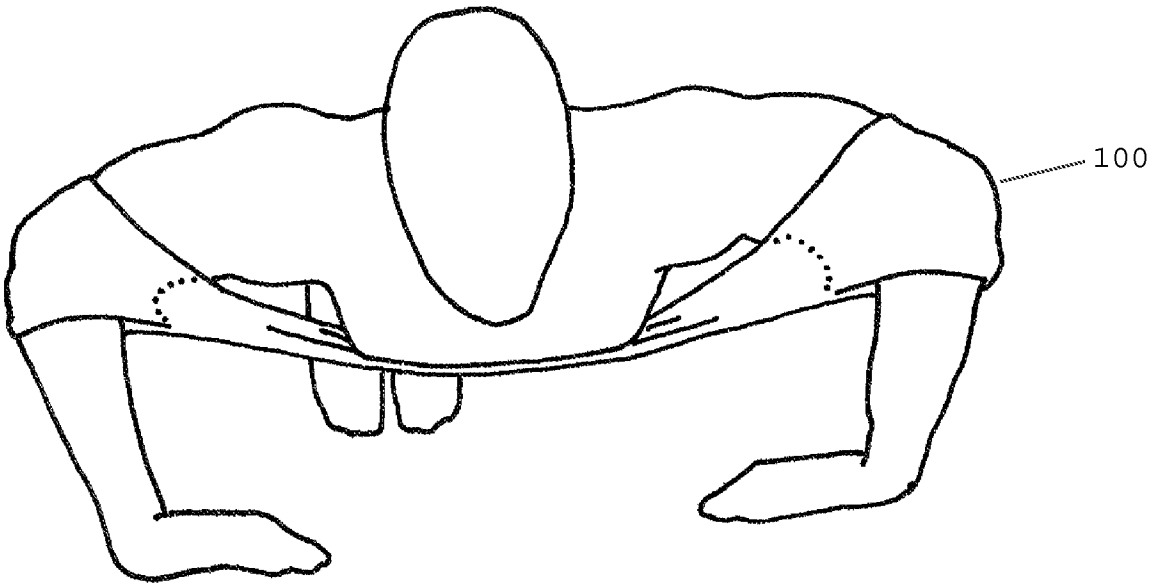

FIGS. 5 and 6 are drawings illustrating an exerciser using the exercise apparatus 100 while doing push-ups. As shown in FIG. 5, the exerciser assumes the start position of a push-up with arms extended and hands on the floor in a similar manner as the exerciser would prepare for push-ups without using the exercise apparatus 100. As the exerciser lowers his body, the arm cuffs 130, 131 and the central portion 132 stretches. As shown in FIG. 6, the exercise apparatus 100 is stretched across the chest of the exerciser and the arm cuffs 130, 131 above the front of the chest of the exerciser. The stretched exercise apparatus 100 provides a force to contract to thereby assist the exerciser in lifting his body as the exerciser pushes his body upward. The exercise apparatus 100 may be used for various forms of push-ups, such as normal push-ups, decline push-ups or push-ups with various hand spacing.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. An exercise apparatus for assisting bench press or push-up exercises comprising:

first and second arm cuffs configured to encircle right and left arms, respectively, of an exerciser, each cuff being configured to encircle an elbow of the arm, a portion of an upper arm of the arm, and a portion of a lower arm of the arm; and a central elastic member having a substantially rectangular shape, the first and second arm cuffs being attached to opposite sides in the longitudinal direction of the central elastic member, the central elastic member having a length sufficient to extend across a chest of the exerciser and for the first and second arm cuffs to encircle the right and left arms, respectively, of the exerciser, wherein the first arm cuff is tapered and the second arm cuff is tapered.

2. The exercise apparatus of claim 1, wherein the central elastic member stretches to allow movement of the right and left arms when the right and left arms of the exerciser are in an eccentric phase of an exercise and contracts when the right and left arms of the exerciser are in a concentric phase of the exercise.

3. The exercise apparatus of claim 1, wherein the central elastic member is elastic in a longitudinal direction and substantially inelastic in a transverse direction.

4. The exercise apparatus of claim 1, wherein each of the first and second arm cuffs includes an opening therein dimensioned to allow the exerciser to grasp the arm cuff for pulling the arm cuff up the arm of the exerciser.

5. The exercise apparatus of claim 1, wherein each of the first and second arm cuffs are elastic to allow stretching in the longitudinal direction.

6. The exercise apparatus of claim 1, wherein each of the first and second arm cuffs is formed of an elastic material to allow stretching in the longitudinal direction and permanently attached to the central elastic member.

7. The exercise apparatus of claim 1, wherein the central elastic member has an elasticity that provides stretching during bench press exercises that provides about 10 to 20 percent assistance in a weight being bench pressed.

8. The exercise apparatus of claim 1, wherein the central elastic member has an elasticity that provides stretching during push up exercises that provides about 10 to 20 percent body weight assistance of body weight of the exerciser.

9. The exercise apparatus of claim 1, wherein the first arm cuff is elastic and is dimensioned to encircle the elbow of the right arm, said portion of the upper right arm, and said portion of the lower right arm of the exerciser during a bench press or push-up exercise, wherein the second arm cuff is elastic and is dimensioned to encircle the elbow of the left arm, said portion of the upper left arm, and said portion of the lower left arm of the exerciser during the bench press or push-up exercise, wherein the central elastic member is further dimensioned in a first configuration to space apart the first arm cuff and the second arm cuff to allow the exercise apparatus to be disposed on or adjacent a chest of the exerciser in a first position of the bench press or push-up exercise at which the elbows of the exerciser are extended away from the chest of the exerciser, wherein the central elastic member is further dimensioned in a second configuration to space apart the first arm cuff and the second arm cuff to allow the exercise apparatus to be disposed on the chest of the exerciser in a second position of the bench press or push-up exercise at which the elbows of the exerciser are located near opposite sides of the chest of the exerciser, wherein the central elastic member stretches from the first configuration to the second configuration to space apart the first arm cuff and the second arm cuff to allow movement of the right and left arms from the first position to the second position in an eccentric phase of the bench press or push-up exercise and contracts from the second configuration to the first configuration to space apart the first arm cuff and the second arm cuff to allow movement of the right and left arms from the second position to the first position in a concentric phase of the bench press or push-up exercise.

10. An exercise apparatus for assisting bench press or push-up exercises comprising:

first and second elastic members, each elastic member having a substantially rectangular shape with first and second long sides and first and second short sides, the first and second elastic members being affixed to each other substantially along the first long sides, each of the first and second short sides being affixed to the first and second elastic members to form first and second arm cuffs configured to encircle right and left arms, respectively, of an exerciser, each cuff being configured to encircle an elbow of the arm, a portion of an upper arm of the arm, and a portion of a lower arm of the arm during the bench press or push-up exercises, each elastic member having a length sufficient to extend across a chest of the exerciser while the first and second arm cuffs encircle the right and left arms, respectively, of the exerciser during the bench press or push-up exercises, wherein each of the first and second arm cuffs includes an opening formed between the first long sides of the first and second elastic members configured to allow the exerciser to grasp the arm cuff for pulling the arm cuff up the arm of the exerciser.

11. The exercise apparatus of claim 10, wherein the first and second elastic members stretch to allow movement of the right and left arms when the right and left arms of the exerciser are in an eccentric phase of an exercise and contract when the right and left arms of the exerciser are in a concentric phase of the exercise.

12. The exercise apparatus of claim 10, wherein the first and second elastic members are elastic in a longitudinal direction and substantially inelastic in a transverse direction.

13. The exercise apparatus of claim 9, wherein the length of the central elastic member is sufficient to be not stretched in the first position of the bench press or push-up exercise and to be stretched at a position between the first position and the second position.

14. An exercise apparatus for assisting bench press or push-up exercises comprising:

first and second elastic members, each elastic member having a substantially rectangular shape with first and second long sides and first and second short sides, the first and second elastic members being affixed to each other substantially along the first long sides, each of the first and second short sides being affixed to the first and second elastic members to form first and second arm cuffs configured to encircle right and left arms, respectively, of an exerciser, each cuff being configured to encircle an elbow of the arm, a portion of an upper arm of the arm, and a portion of a lower arm of the arm during the bench press or push-up exercises, each elastic member having a length sufficient to extend across a chest of the exerciser while the first and second arm cuffs encircle the right and left arms, respectively, of the exerciser during the bench press or push-up exercises, wherein the first arm cuff is tapered and the second arm cuff is tapered.

15. The exercise apparatus of claim 14, wherein the first and second elastic members are elastic in a longitudinal direction and substantially inelastic in a transverse direction.

16. The exercise apparatus of claim 14, wherein each of the first elastic member and the second elastic member has an elasticity that provides stretching during bench press exercises that provides about 10 to 20 percent assistance in a weight being bench pressed.

17. The exercise apparatus of claim 14, wherein each of the first elastic member and the second elastic member has an elasticity that provides stretching during push up exercises that provides about 10 to 20 percent body weight assistance of body weight of the exerciser.

18. The exercise apparatus of claim 14, wherein a section of the first elastic member between the first and second arm cuffs and a section of the second elastic member between the first and second arm cuffs are dimensioned in a first configuration to space apart the first arm cuff and the second arm cuff to allow the exercise apparatus to be disposed on or adjacent a chest of the exerciser in a first position of the bench press or push-up exercises at which the elbows of the exerciser are extended away from the front of the chest of the exerciser, wherein the section of the first elastic member between the first and second arm cuffs and the section of the second elastic member between the first and second arm cuffs are dimensioned in a second configuration to space apart the first arm cuff and the second arm cuff to allow the exercise apparatus to be disposed on the chest of the exerciser in a second position of the bench press or push-up exercises at which the elbows of the exerciser are located near opposite sides of the chest of the exerciser, wherein the first and second elastic members stretch from the first configuration to the second configuration to space apart the first arm cuff and the second arm cuff to allow movement of the right and left arms from the first position to the second position in an eccentric phase of the exercise and contract from the second configuration to the first configuration to space apart the first arm cuff and the second arm cuff to allow movement of the right and left arms from the second position to the first position in a concentric phase of the exercise.

19. The exercise apparatus of claim 17, wherein the length of the first and second elastic members is sufficient to be not stretched in the first position of the exercise and to be stretched at a position between the first position and the second position.

20. The exercise apparatus of claim 14, wherein each of the first and second arm cuffs includes an opening formed between the first long sides of the first and second elastic members configured to allow the exerciser to grasp the arm cuff for pulling the arm cuff up the arm of the exerciser.

21. The exercise apparatus of claim 10, wherein each of the first elastic member and the second elastic member has an elasticity that provides stretching during bench press exercises that provides about 10 to 20 percent assistance in a weight being bench pressed.

22. The exercise apparatus of claim 10, wherein each of the first elastic member and the second elastic member has an elasticity that provides stretching during push up exercises that provides about 10 to 20 percent body weight assistance of body weight of the exerciser.

23. The exercise apparatus of claim 14, wherein the first and second elastic members stretch to allow movement of the right and left arms when the right and left arms of the exerciser are in an eccentric phase of an exercise and contract when the right and left arms of the exerciser are in a concentric phase of the exercise.

24. The exercise apparatus of claim 10, wherein a section of the first elastic member between the first and second arm cuffs and a section of the second elastic member between the first and second arm cuffs are dimensioned in a first configuration to space apart the first arm cuff and the second arm cuff to allow the exercise apparatus to be disposed on or adjacent a chest of the exerciser in a first position of the bench press or push-up exercises at which the elbows of the exerciser are extended away from the front of the chest of the exerciser, wherein the section of the first elastic member between the first and second arm cuffs and the section of the second elastic member between the first and second arm cuffs are dimensioned in a second configuration to space apart the first arm cuff and the second arm cuff to allow the exercise apparatus to be disposed on the chest of the exerciser in a second position of the bench press or push-up exercises at which the elbows of the exerciser are located near opposite sides of the chest of the exerciser, wherein the first and second elastic members stretch from the first configuration to the second configuration to space apart the first arm cuff and the second arm cuff to allow movement of the right and left arms from the first position to the second position in an eccentric phase of the exercise and contract from the second configuration to the first configuration to space apart the first arm cuff and the second arm cuff to allow movement of the right and left arms from the second position to the first position in a concentric phase of the exercise.

25. The exercise apparatus of claim 24, wherein the length of the first and second elastic members is sufficient to be not stretched in the first position of the exercise and to be stretched at a position between the first position and the second position.

* * * * *